US012121116B1

(12) United States Patent
Chung

(10) Patent No.: US 12,121,116 B1
(45) Date of Patent: Oct. 22, 2024

(54) FLAT BOTTOM RESIN ZIPPER

(71) Applicant: KCC ZIPPER CO., LTD., Tong Xiang (CN)

(72) Inventor: Chun-Yen Chung, New Taipei (TW)

(73) Assignee: KCC ZIPPER CO., LTD., Zhejiang (CN)

( * ) Notice: Subject to any disclaimer, the term of this patent is extended or adjusted under 35 U.S.C. 154(b) by 0 days.

(21) Appl. No.: 18/209,938

(22) Filed: Jun. 14, 2023

(30) Foreign Application Priority Data

Apr. 6, 2023 (TW) ..... 112112908
Apr. 6, 2023 (TW) ..... 112203135

(51) Int. Cl.
*A44B 19/34* (2006.01)
*A44B 19/14* (2006.01)
*A44B 19/06* (2006.01)

(52) U.S. Cl.
CPC ..... *A44B 19/34* (2013.01); *A44B 19/14* (2013.01); *A44B 19/06* (2013.01); *Y10T 24/2536* (2015.01); *Y10T 24/2548* (2015.01)

(58) Field of Classification Search
CPC ..... A44B 19/34; A44B 19/10; A44B 19/12; A44B 19/14; A44B 19/40; A44B 19/403; A44B 19/06; Y10T 24/2548; Y10T 24/2552; Y10T 24/2557; Y10T 24/2536
See application file for complete search history.

(56) References Cited

U.S. PATENT DOCUMENTS 4,291,440 A * 9/1981 Yoshida ..... B29C 66/729 24/408
4,312,102 A * 1/1982 Fukuroi ..... A44B 19/32 24/410
4,418,449 A * 12/1983 Heimberger ..... A44B 19/406 24/410
4,639,981 A * 2/1987 Yoshida ..... A44B 19/14 24/401
4,765,038 A * 8/1988 Kasai ..... A44B 19/34 24/410
9,215,912 B2 * 12/2015 Kondo ..... A44B 19/26
2013/0133161 A1 * 5/2013 Ren ..... A44B 19/303 24/434
2013/0174388 A1 * 7/2013 Ren ..... A44B 19/04 24/427
2015/0033512 A1 * 2/2015 Kojima ..... A44B 19/06 24/430
2020/0022467 A1 * 1/2020 Dhadwal ..... A44B 19/262

* cited by examiner

*Primary Examiner* — Robert Sandy
*Assistant Examiner* — Rowland Do
(74) *Attorney, Agent, or Firm* — Ying-Ting Chen; Law Office of Michael Chen

(57) ABSTRACT

The invention discloses a flat bottom resin zipper, which injects resin chain teeth onto a core wire or a chain cloth. Each resin chain tooth has a sewing thread slot on the top and a chain cloth embedding groove on the bottom. Then sew the entire resin chain teeth to the chain cloth, so that the sewing threads are tightened in the sewing thread slots, and the chain cloth is embedded in the chain cloth embedding grooves, forming a double fixed structure of injection molding and sewing thread sewing. Afterwards, the inner side of the chain cloth is folded back to form a flat bottom zipper with only the chain cloth on one side of the zipper without any protruding resin chain tooth, which can be used as an anti-pinch zipper or an invisible zipper.

10 Claims, 9 Drawing Sheets

FLAT BOTTOM RESIN ZIPPER

BACKGROUND OF THE INVENTION

(a) Field of the Invention

The present invention relates to a zipper, especially a flat-bottomed resin zipper in which resin teeth are injection-molded and sewn on one side of a chain cloth, and the other side of the chain cloth has no protruding teeth.

(b) Description of the Prior Art

The known resin zipper is to injection mold the resin teeth on the inner side of the chain cloth to form a structure in which the rear end of each resin tooth is clamped on both sides of the chain cloth, so the appearance of the entire row of resin chain teeth can be seen on both sides of the chain cloth. Because there are protruding chain teeth on the front and back of the chain cloth, when the zipper is applied to the clothing, it may affect the overall appearance, and the zipper slider is easy to be caught in the inner lining of the clothing when it slides.

Conventional resin chain teeth must be directly injection molded on the chain cloth. If the resin chain teeth are separately injection-molded first, there will be a problem that the resin chain teeth are difficult to combine with the chain cloth. Because most of the resin chain teeth that are separately injection molded according to the existing technology are small in structure and size, it is difficult to neatly arrange a large number of scattered resin chain teeth on the chain cloth one by one, and at the same time use the sewing threads of the sewing machine device for sewing and fixing.

Furthermore, the known chain teeth and chain cloth are sewn together with sewing threads, because both the sewing threads and the chain cloth have some elasticity and slack, and it is difficult to overcome the lateral tension of the chain cloth when the chain teeth and chain cloth are sewn together with sewing threads. Lateral pull. When sutures are used to sew the sprocket to the chain cloth, it is also difficult to overcome. For this reason, how to solve the technical problem that the resin chain teeth can be separately injection molded and then be fixed on the chain cloth with sewing threads, and how to improve the effect of resisting lateral tension is the problem to be actively overcome by the present invention.

SUMMARY OF THE INVENTION

The main object of the present invention is to provide a flat bottom resin zipper, which pre-injects resin chain teeth on a core wire, where each resin chain tooth has a sewing thread slot on the top and a chain cloth embedding groove on the bottom, then the resin chain teeth are arranged on the chain cloth for sewing thread sewing, so that the sewing threads on one side are embedded and tightened in the sewing thread slots of the resin chain teeth, and the chain cloth on the other side is embedded in the chain cloth embedding grooves, and afterwards, the chain cloth is reflexed to become a flat-bottomed zipper structure, so that the resin chain teeth can be injection molded separately and then sewn on the chain cloth, which can strengthen the combination and stability of the resin chain teeth and chain cloth.

The second object of the present invention is to provide a flat bottom resin zipper, through the pre-injection molding of the plurality of resin chain teeth on the chain cloth, each resin chain tooth has a sewing thread slot on the top and a chain cloth embedding groove on the bottom, so that the sewing threads can be tightly bound in the sewing thread slots and chain cloth embedding grooves, and then the chain cloth is folded back to form a flat-bottomed zipper structure to achieve the function of strengthening the combination stability of resin chain teeth and chain cloth.

Still another object of the present invention is to provide a flat bottom resin zipper, which achieves the function of stably embedding sewing threads and chain cloth into sewing thread slots and chain cloth embedding grooves through the special sewing method and structure of multiple sewing threads.

DETAILED DESCRIPTION OF THE PREFERRED EMBODIMENTS

First Embodiment

Figure 1:
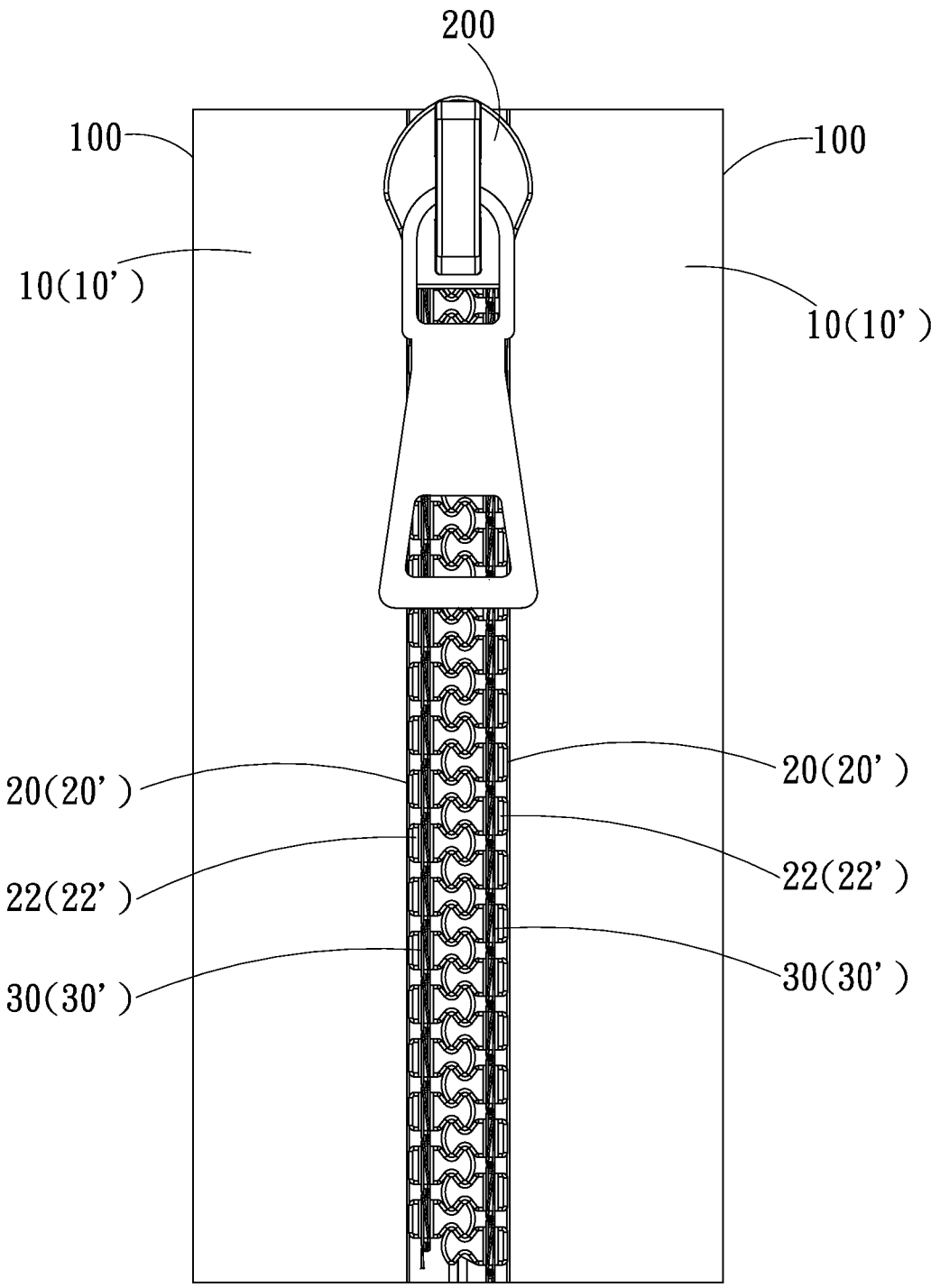
FIG. 1 is a schematic diagram of the first embodiment of the flat bottom resin zipper of the present invention.
Figure 2:
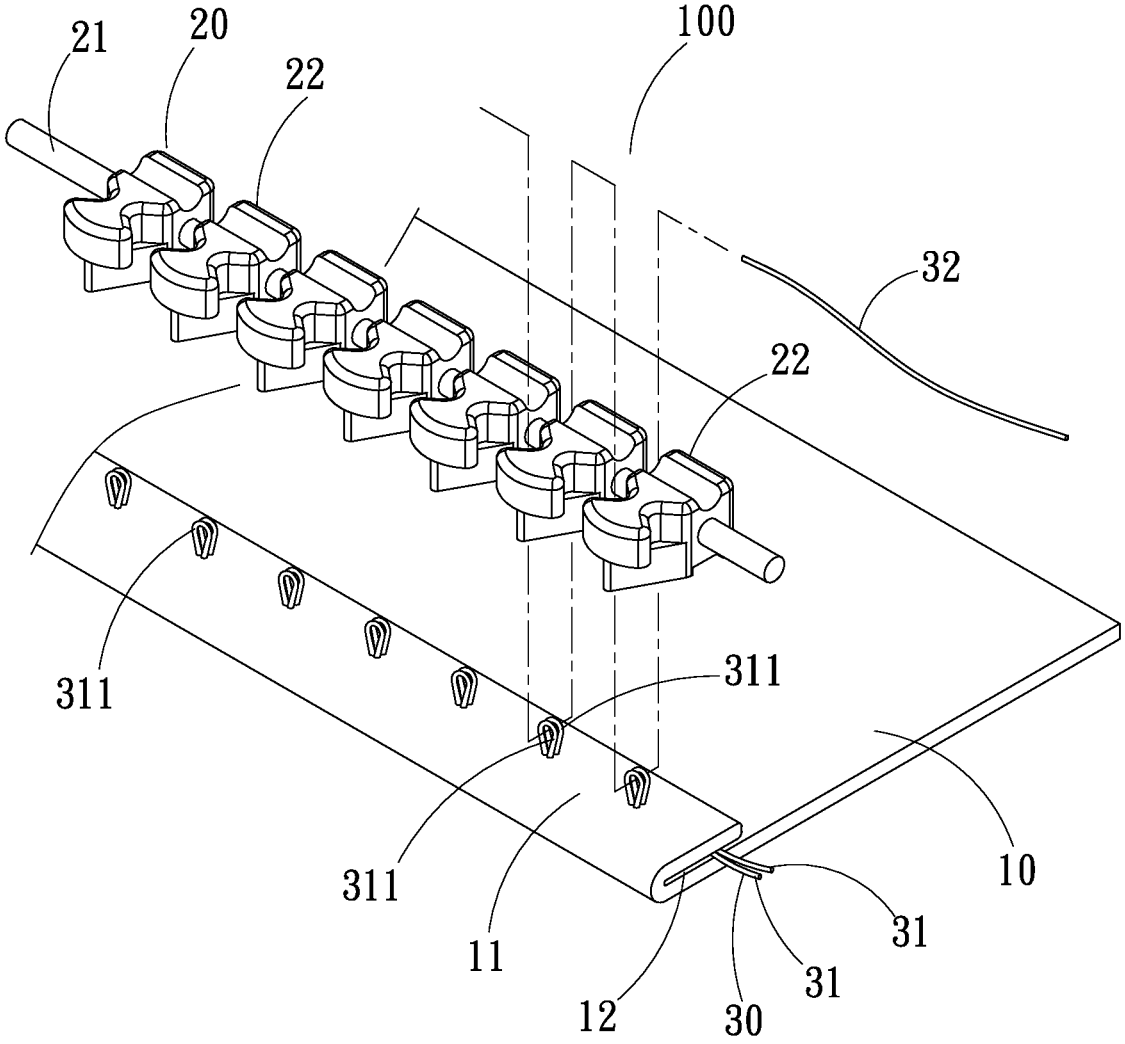
FIG. 2 is an exploded schematic diagram of a single-side zipper tape in the zipper shown in FIG. 1.

As shown in FIG. 1 and FIG. 2, a flat bottom resin zipper of the present invention, its first preferred embodiment comprises two zipper tapes 100 and a zipper slider 200. Each zipper tape 100 is composed of a chain cloth 10, a chain tooth bar 20 and a plurality of sewing threads 30.

As shown in FIG. 2, the chain tooth bar 20 comprises a core wire 21, the core wire 21 is made of nylon or natural fiber, and the core wire 21 is pre-arranged with a plurality of injection-molded resin chain teeth 22. As shown in FIG. 3 to FIG. 6, each of the resin chain teeth 22 adopts plastic or synthetic resin injection molding to comprise a rectangular block 221, a through hole 222 connecting the two sides of the rectangular block 221, a chain tooth head 223 formed at one end of the rectangular block 221, and a sewing thread slot 224 recessed downward from the top of the rectangular block 221. The sewing thread slot 224 is a semicircular groove, and its two ends extend to both sides of the rectangular block 221. When the resin chain teeth 22 are injection molded, a core wire 21 is first passed through the mold, and then each resin chain tooth 22 is injection molded on the core wire 21 to form a structure in which the core wire 21 is penetrated and fixed on the through hole 222, so that the resin chain teeth 22 are arranged on the core wire 21 at intervals.

Figure 3:
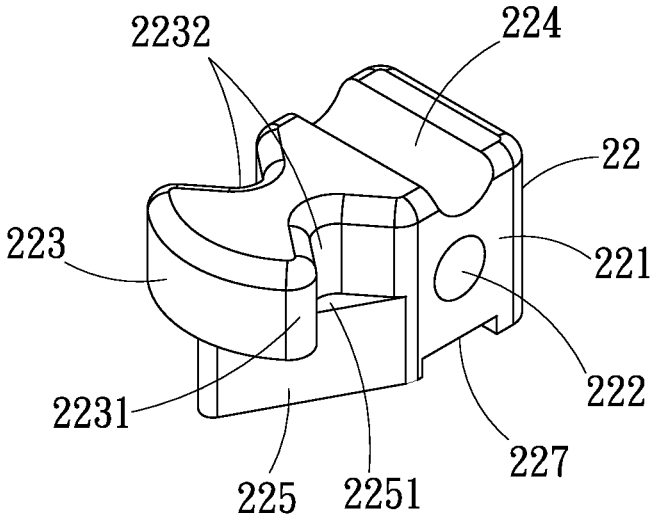
FIG. 3 is a top perspective view of the resin chain tooth in FIG. 2.
Figure 4:
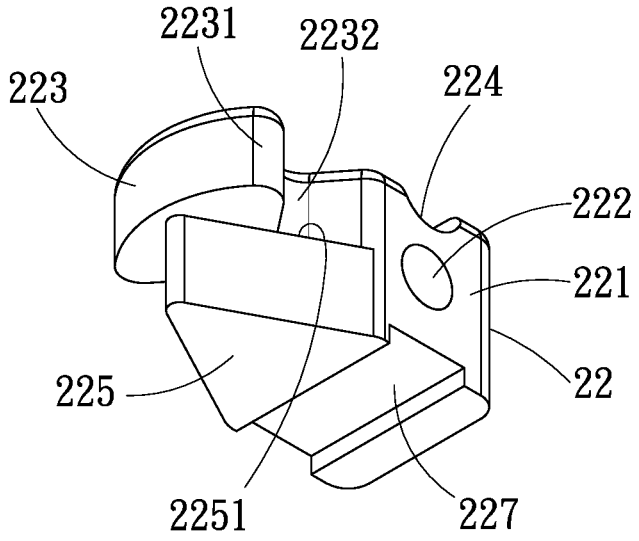
FIG. 4 is a schematic perspective view of the bottom of the resin chain tooth in FIG. 3.
Figure 5:
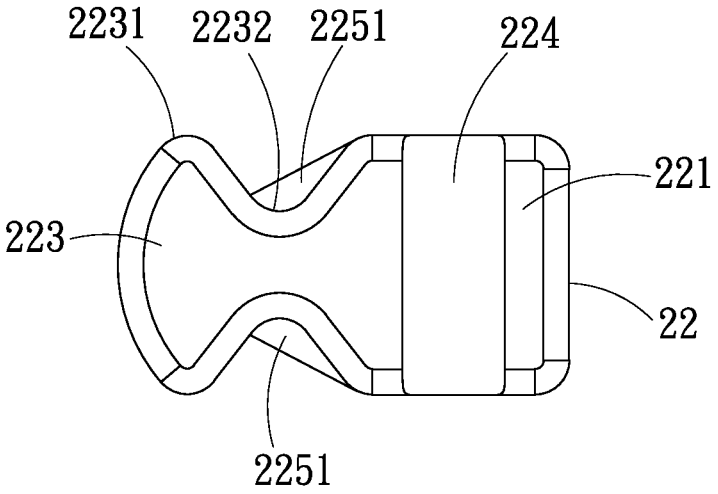
FIG. 5 is a top view of the resin chain tooth in FIG. 2.

As shown in FIG. 3 and FIG. 4, one end of the above-mentioned rectangular block 221 is integrally formed with a support block 225, the support block 225 is a triangular block whose tip faces the chain tooth head 223, so that the support block 225 is integrally connected to the lower side of the chain tooth head 223. The two sides of the chain tooth head 223 respectively form an engaging protrusion 2231 and an engaging recess 2232, so that the engaging protrusions 2231 on both sides of the chain tooth head 223 protrude from the two sides of the support block 225, and the width between the engaging recesses 2232 is smaller than the support block 225, therefore, the support block 225 forms a support surface 2251 at the bottom end of the engaging recesses 2232. In this way, when the resin chain teeth 22 are engaged, the engaging protrusion 2231 can abut against the support surface 2251 of another chain tooth and engage with the engaging recess 2232.

The above-mentioned chain tooth bar 20 of the present invention is connected in series through the core wire 21, so that most resin chain teeth 22 do not need to be directly injection-molded on the chain cloth 10. Therefore, it is allowed to make the chain tooth bar 20 first during production, and then select the corresponding chain tooth bar 20 according to the color or size specification of the chain cloth 10 and sew it on the chain cloth 10. As shown in FIG. 2 and FIG. 6 to FIG. 8, when sewing, the chain tooth bar 20 is arranged parallel to the second surface of the chain cloth 10, so that the underside of the rectangular blocks 221 fit on the second surface of the chain cloth 10, and the chain tooth heads 223 protrude from inner side of the chain cloth 10. Then use some sewing threads 30 to sew, make the sewing threads 30 wind around in the sewing thread slots 224 of the resin chain teeth 22, and make the sewing threads 30 sew on the chain cloth 10 between each of the resin chain teeth 22, so that each resin chain tooth 22 is stitched and fixed on the second surface of the chain cloth 10.

Figure 6:
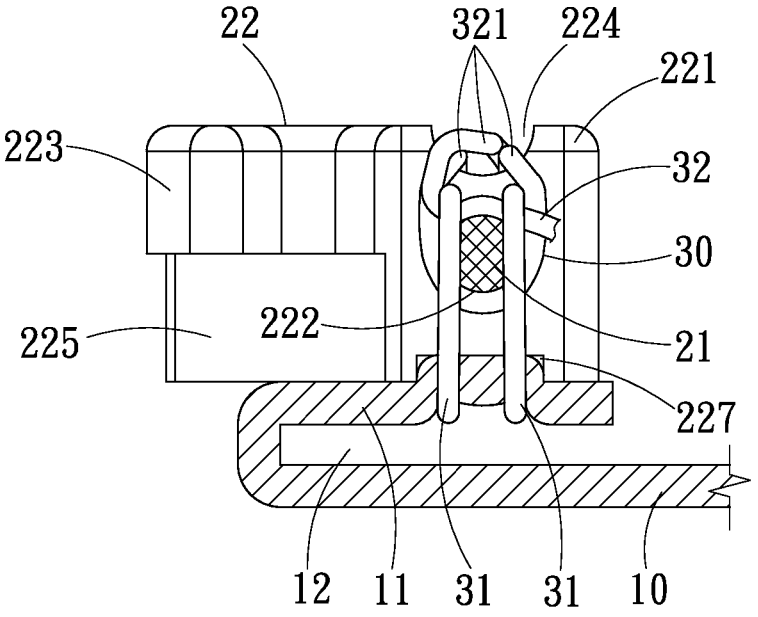
FIG. 6 is a schematic side view of the resin chain tooth in FIG. 5.
Figure 7:
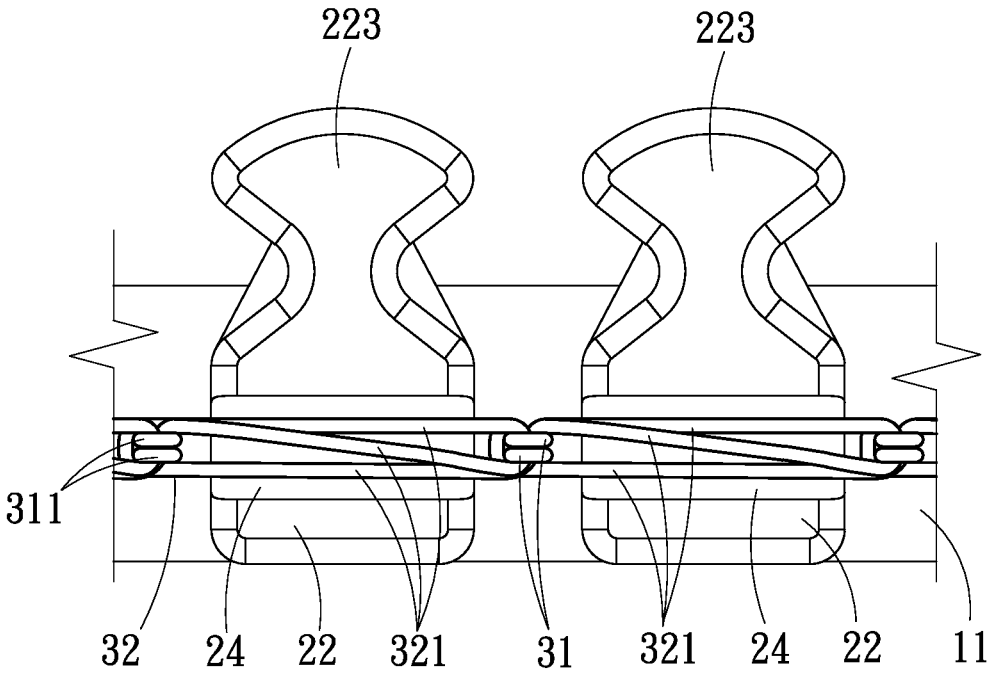
FIG. 7 is a top schematic view of the sewing thread fixed on the sewing thread slot in FIG. 1.
Figure 8:
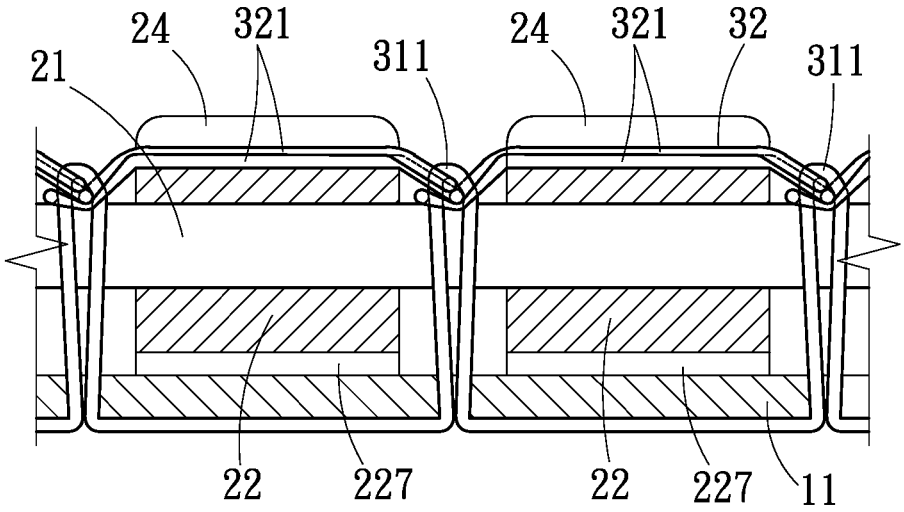
FIG. 8 is a schematic cross-sectional view of the sewing thread fixed in the sewing thread slot in FIG. 7.

As shown in FIG. 2 and FIG. 6, after the stitching is completed according to the above structure, the inner side of the chain cloth 10 together with the chain tooth bar 20 is folded back to the outer side of the chain cloth 10, so that the chain cloth 10 forms a chain tooth belt 11 and a sliding space 12 between the chain tooth belt 11 and the chain cloth 10. Therefore, the above-mentioned chain tooth bar 20 is located on the chain tooth belt 11 opposite to the sliding space 12. At this time, the two first sewing threads 31 are located on the first surface of the chain tooth belt 11. With this structure of reversing the chain cloth 10, one side of the zipper is only the chain cloth 10 and there is no protruding chain tooth surface with a flat bottom zipper structure. The side without chain teeth can be used as the back (inner side) of the anti-pinch zipper, so that the chain teeth and zipper slider are located on the front (outer side) of the zipper, preventing the resin chain teeth 22 from being caught in the inner lining of the clothing. The side without chain teeth can also be used as the front (outer side) of the invisible zipper, hiding the chain teeth and zipper slider on the back (inner side) of the zipper, so that there are no protruding resin chain teeth 22 and zipper slider on the outer side of the clothing.

As shown in FIG. 2 and FIG. 6 to FIG. 8, the several sewing threads 30 of the present invention preferably have two first sewing threads 31 and one second sewing thread 32. The two first sewing threads 31 are located on the first surface of the chain cloth 10, and the two first sewing threads 31 are continuously passed through the gaps between the resin chain teeth 22 to the second surface of the chain cloth 10 through a sewing machine and then are folded back to the first surface of the chain cloth 10, so that the two first sewing threads 31 form two loops 311 at each gap on the second surface of the chain cloth 10, and the two first sewing threads 31 are fastened to the first surface of the chain cloth 10. The second sewing thread 32 repeatedly passes through the two loops 311 of the first sewing threads 31 on both sides of each resin chain tooth 22 on the second surface of the chain cloth 10. The second sewing thread 32 is continuously operated by the sewing machine to form a three-segment thread body 321 in which the second sewing thread 32 is fastened in the sewing thread slots 224. In this way, the three-segment thread body 321 is embedded in the sewing thread slot 224, which can prevent the resin chain tooth 22 from sliding off, and at the same time prevent the zipper slider 200 from rubbing against the second sewing thread 32.

Figure 9:
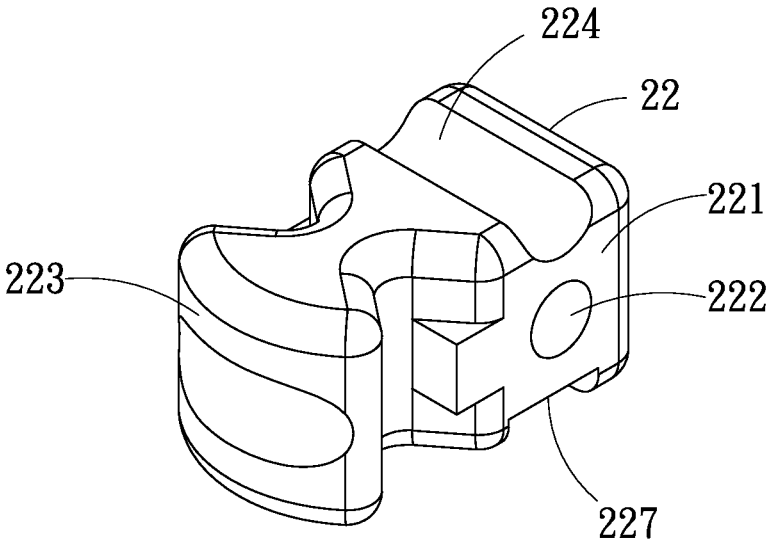
FIG. 9 is a top perspective view of another embodiment of the resin chain tooth of the present invention.
Figure 10:
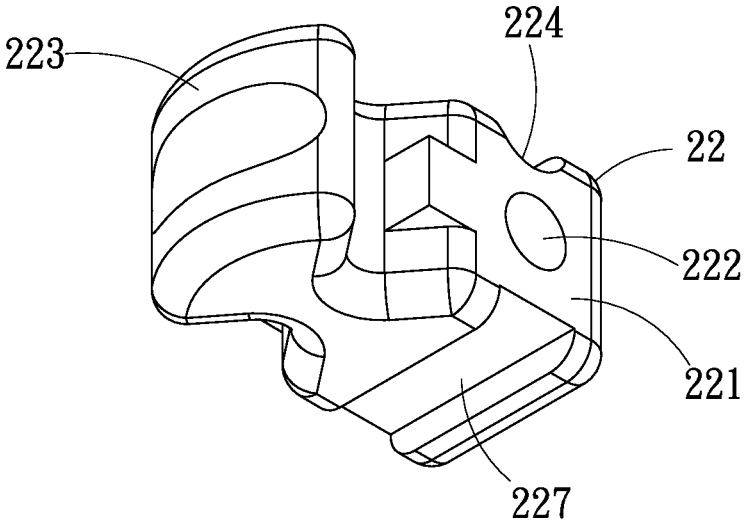
FIG. 10 is a schematic perspective view of the bottom of the resin chain tooth in FIG. 9.
Figure 11:
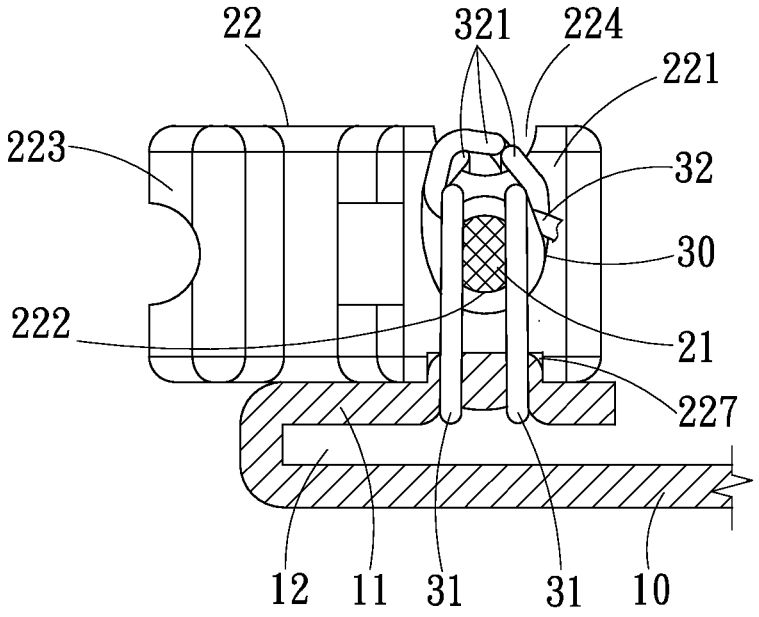
FIG. 11 is a schematic diagram of the resin chain tooth in FIG. 9 being sewn on the single-sided chain cloth.

As shown in FIG. 9 to FIG. 11, it is another embodiment of the resin chain tooth 22 of the present invention, which differs from the above-mentioned first embodiment in that: The height of the chain tooth head 223 of the resin chain tooth 22 is the same as that of the rectangular block 221, so there is no above-mentioned triangular support block 225 below the chain tooth head 223, so that the chain tooth head 223 at one end of the entire resin chain tooth 22 can be used for the two zipper tapes 100 to bite each other. As for the structure and method of sewing it on the chain cloth 10 (as shown in FIG. 11), it is the same as above-mentioned FIG. 6 to FIG. 8. It can be known that the present invention can implement different chain tooth heads 223 to achieve the purpose of flat bottom resin zipper.

As shown in FIG. 4, FIG. 6, FIG. 10 and FIG. 11, the rectangular block 221 of the resin chain tooth 22 of the present invention can be provided with a chain cloth embedding groove 227 that is recessed from the bottom to the top. The chain cloth embedding groove 227 is a groove with a rectangular or semicircular section, and is connected to both sides of the rectangular block 221. Through the structural design of the chain cloth embedding groove 227, when the above-mentioned first sewing thread 31 is fastened to the first surface of the chain cloth 10, not only the first sewing thread 31 will fall into the softer chain cloth 10, but also the chain cloth 10 can be embedded in the chain cloth embedding groove 227 after being pressed by the first sewing thread 31 (as shown in FIG. 6 or FIG. 11). In this way, a structure in which the chain cloth 10 is fitted with the chain cloth embedding groove 227 is formed, so that the zipper can effectively resist the transverse pulling force of the chain cloth 10.

Second Embodiment

Figure 12:
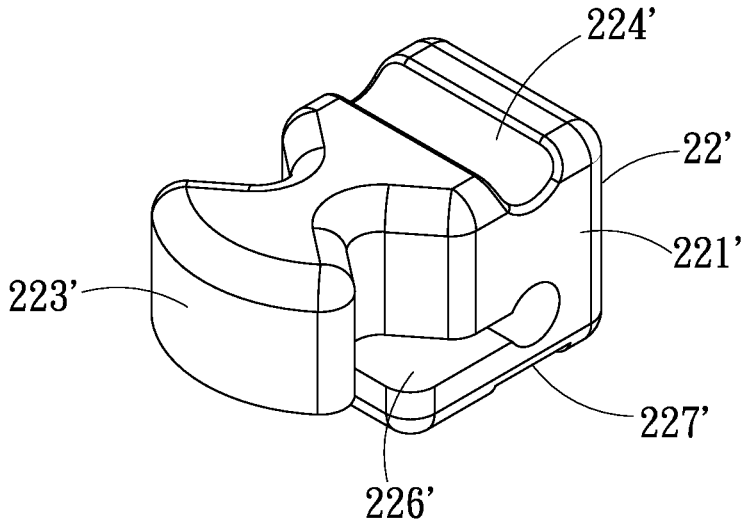
FIG. 12 is a top perspective view of the second embodiment of the resin chain tooth of the present invention.

As shown in FIG. 1, it is two embodiments of the present invention. The zipper tape 100 also comprises a chain cloth 10', a chain tooth bar 20' and several sewing threads 30'. As shown in FIG. 12 and FIG. 13 again, its difference with the above-mentioned first embodiment is: The chain tooth bar 20' does not implement the above-mentioned core wire 21, and directly injects and molds most resin chain teeth 22' on the inner side of the chain cloth 10'; each resin chain tooth 22' comprises an integrally formed a rectangular block 221', a cloth groove 226' laterally recessed from one end of the rectangular block 221' towards the other end to replace the above-mentioned through hole 222, a chain tooth head 223' formed at one end of the rectangular block 221' for engagement, a sewing thread slot 224' recessed from the top of the rectangular block 221' to its bottom, and at least one chain cloth embedding groove 227' recessed from the bottom of the rectangular block 221' toward its top. The sewing thread slot 224' and the chain cloth embedding groove 227' also extend to both sides of the rectangular block 221' respectively. The cloth groove 226' is extended from the end of the chain tooth head 223' to the rectangular block 221', for when the resin chain tooth 22' is injection molded on the inner side of the chain cloth 10', the chain cloth 10' is clamped on the cloth groove 226'.

Figure 13:
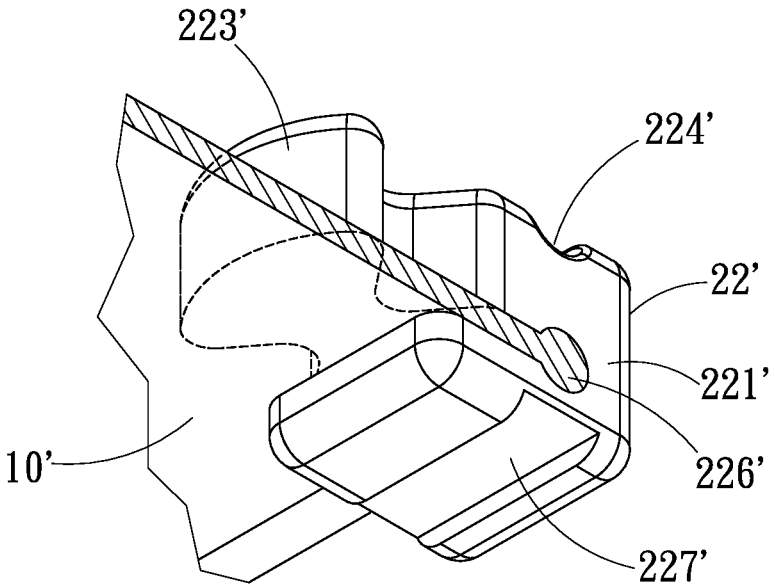
FIG. 13 is a schematic perspective view of the bottom of the resin chain tooth in FIG. 12.
Figure 14:
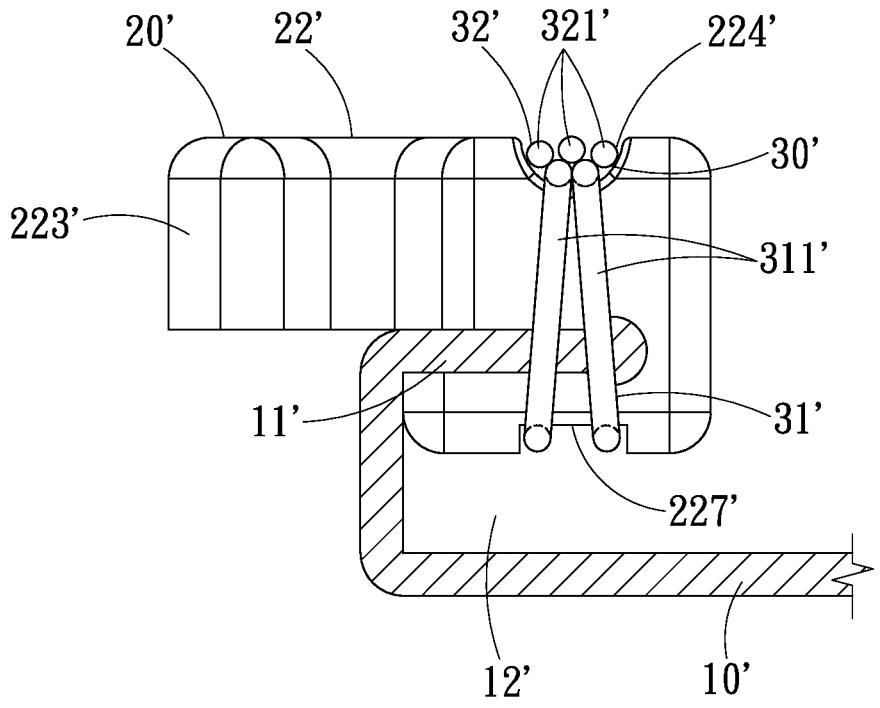
FIG. 14 is a schematic diagram of the resin chain tooth in FIG. 12 being injection molded and sewn on the single-sided chain cloth.

As shown in FIG. 13, when the resin chain tooth 22' is injection molded, the inner side of the chain cloth 10' will be clamped in the cloth groove 226', and the chain tooth head 223' will temporarily face the outer side of the chain cloth 10' in this state. Then, as shown in FIG. 14, use several sewing threads 30' to sew in the sewing thread slot 224' and chain cloth embedding groove 227' of each resin chain tooth 22', so that the sewing threads 30' are sewed to the chain cloth 10' in the gap between resin chain teeth 22', and the sewing threads 30' are embedded and tightened in the sewing thread slots 224' and the chain cloth embedding grooves 227'. The chain cloth embedding groove 227', in addition to having the function of providing the fitting of the chain cloth 10 in the above-mentioned first embodiment, can also be used as a positioning groove for fitting of two first sewing threads 31 in this embodiment, to strengthen the stability of the combination of the resin chain teeth 22' and the chain cloth 10', and prevent the sewing threads 30' from being moved or worn due to lateral tension.

Figure 15:
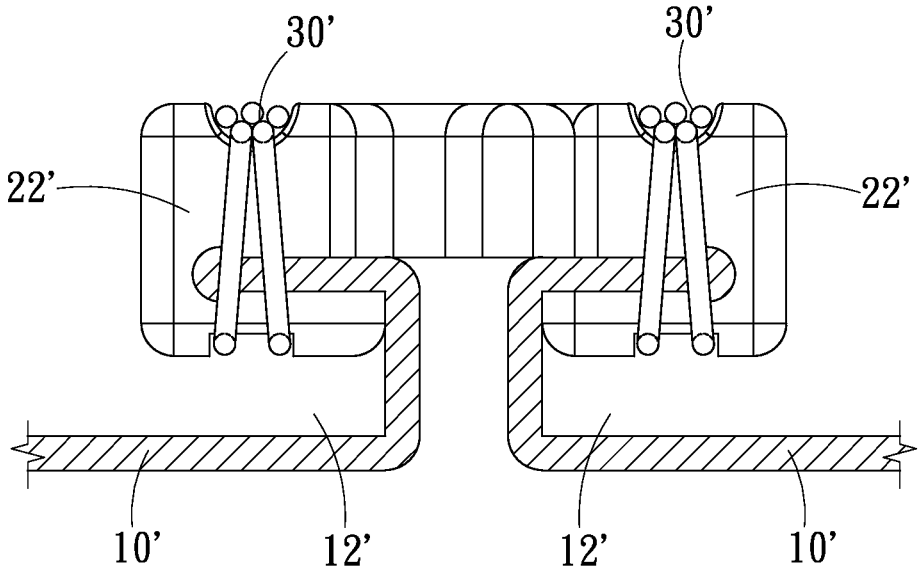
FIG. 15 is a schematic diagram of meshing resin chain teeth of the double-sided chain cloth in FIG. 14.

As shown in FIG. 14 and FIG. 15, after the resin chain teeth 22' are injection molded on the chain cloth 10', the inner side of the chain cloth 10' can be turned back to the outer side of the chain cloth 10' to form a chain tooth belt 11' and a sliding space 12' between the chain tooth belt 11' and the chain cloth 10', so that the chain tooth heads 223' of the resin chain teeth 22' protrude from the reversing edge of the chain cloth 10'. In this way, a flat bottom zipper with only the chain cloth 10' on one side of the zipper without any protruding resin chain tooth 22 is formed. The zipper made in this embodiment can also use the side without chain teeth (only chain cloth 10') as the back (inner side) of the anti-pinch zipper, and the side with resin chain teeth 22' can be used as the front (outer side) of the zipper, to achieve the anti-pinch function that the resin chain teeth 22' will not touch the inner lining of the clothing. In this implementation, the side without chain teeth can also be used as the front (outer side) of the invisible zipper, and the side with resin chain teeth 22' can be used as the back (inner side) of the zipper, so that the resin chain teeth 22' are hidden behind the zipper, and there is no protruding resin chain teeth 22 outside the clothing.

As shown in FIG. 14 and FIG. 15, the sewing threads 30' of this embodiment also include two first sewing threads 31' and one second sewing thread 32'. The two first sewing threads 31' are wound around the chain cloth embedding grooves 227' of the resin chain teeth 22' to prevent the second sewing thread 32' from being moved or worn by lateral tension, and the two first sewing threads 31' are continuously passed through the gaps between the resin chain teeth 22' to the second surface of the chain tooth belt 11' and then are folded back to the first surface of the chain tooth belt 11' (see FIG. 2), so that two loops 311' are formed at the gap on the second surface of the chain tooth belt 11'. The second sewing thread 32' repeatedly passes through the loops 311' on both sides of each resin chain tooth 22', so that the second sewing thread 32' forms a multi-segment thread body 321' embedded and tightened in the sewing thread slots 224'. It achieves the effects of tightening the resin chain teeth 22' and preventing the first sewing threads 31' and the second sewing thread 32' from moving or being worn, and the zipper can effectively resist the transverse pulling force of the chain cloth 10.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A flat bottom resin zipper comprising two zipper tapes, each said zipper tape comprising a chain cloth, a chain tooth bar and a plurality of sewing threads wherein:

said chain tooth bar comprises a core wire and a plurality of resin chain teeth injection molded on said core wire, each said resin chain tooth comprising a rectangular block, a through hole connecting two opposite sides of said rectangular block, a chain tooth head formed at one end of said rectangular block and a sewing thread slot recessed from a top of said rectangular block to a bottom of said rectangular block, said sewing thread slot extending to said two opposite sides of said rectangular block;

when said resin chain teeth are injection molded, said core wire is formed to pass through the through hole of each said resin chain tooth, so that said resin chain teeth are arranged at intervals on said core wire, said chain tooth bar being set on said chain cloth so that a lower side of said rectangular block fits on a second surface of said chain cloth;

said sewing threads are wound in said sewing thread slot of each said resin chain tooth, said sewing threads being sewn on said chain cloth between each said resin chain tooth, and each said resin chain tooth being fixed on the said second surface of said chain cloth; and an inner side of said chain cloth is folded toward an outer side of said chain cloth to form a chain tooth belt and a sliding space between said chain tooth belt and said chain cloth, said chain tooth bar being located on the side of said chain tooth belt opposite said sliding space to hide said resin chain teeth on one side of said chain cloth.

2. The flat bottom resin zipper as claimed in claim 1, wherein the bottom of said rectangular block of each said resin chain tooth is provided with a chain cloth embedding groove recessed from the bottom of each said resin chain tooth to the top thereof, two first sewing threads of said sewing threads forcing said chain cloth to be embedded in said chain cloth embedding groove when tightened to a first surface of said chain cloth.

3. The flat bottom resin zipper as claimed in claim 2, wherein said chain cloth embedding groove is a groove with a rectangular or semicircular section.

4. The flat bottom resin zipper as claimed in claim 2, wherein said sewing threads comprise two first sewing threads and one second sewing thread, said two first sewing threads being located on a first surface of said chain cloth, said two first sewing threads being continuously threaded through the gap between each two adjacent said resin chain teeth to a second surface of said chain cloth and then folded back to a first surface of said chain cloth so as to form two loops at the gap between each two adjacent said resin chain teeth on said second surface of said chain cloth, said second sewing thread repeatedly passing through the said loops of said first sewing threads on both sides of each said resin chain tooth, so that said second sewing thread forms a three-segment thread body tightly bound in said sewing thread slot.

5. The flat bottom resin zipper as claimed in claim 1, wherein one end of said rectangular block is integrally formed with a support block, and said support block is integrally connected to the bottom of said chain tooth head; the two opposite sides of said chain tooth head respectively form an engaging protrusion and an engaging recess, so that the said engaging protrusions on the two opposite sides of said chain tooth head protrude from the two opposite sides of said support block, the width between the said engaging recesses on the two opposite sides of said chain tooth head being smaller than said support block, said support block forming a support surface at a bottom of said engaging recesses.

6. The flat bottom resin zipper as claimed in claim 5, wherein said support block is a triangular block with the tip pointing towards said chain tooth head.

7. The flat bottom resin zipper as claimed in claim 1, wherein said chain tooth head has the same height as said rectangular block.

8. A flat bottom resin zipper comprising two zipper tapes, each said zipper tape comprising a chain cloth, a chain tooth bar and a plurality of sewing threads, wherein:

said chain tooth bar is pre-injection molded on an inner side of said chain cloth with a plurality of resin chain teeth, each said resin chain tooth comprising a rectangular block, a cloth groove recessed laterally from one end of said rectangular block toward an opposite end of said rectangular block, a chain tooth head formed at one end of said rectangular block, a sewing thread slot recessed from a top of said rectangular block to a bottom of said rectangular block and a chain cloth embedding groove recessed from the bottom of said rectangular block toward the top of said rectangular block, said sewing thread slot and said chain cloth embedding groove respectively extending to two opposite sides of said rectangular block;

when said resin chain teeth are injection molded, an inner side of said chain cloth is clamped in said cloth groove of each said resin chain tooth, so that said resin chain teeth are arranged at intervals on the inner side of said chain cloth;

said sewing threads are wound in said sewing thread slot and said chain cloth embedding groove of each said resin chain tooth, and said sewing threads are sewn to said chain cloth at the gap between each two adjacent said resin chain teeth; and an inner side of said chain cloth is folded toward an outer side of said chain cloth to form a chain tooth belt and a sliding space between said chain tooth belt and said chain cloth, said chain tooth bar being located on the side of said chain tooth belt opposite said sliding space to hide said resin chain teeth on one side of said chain cloth.

9. The flat bottom resin zipper as claimed in claim 8, wherein said sewing threads comprise two first sewing threads and one second sewing thread, said two first sewing threads being wound in said chain cloth embedding grooves of said resin chain teeth, said two first sewing threads being continuously threaded through the gap between each two adjacent said resin chain teeth to a second surface of said chain cloth and then folded back to a first surface of said chain cloth so as to form two loops at the gap between each two adjacent said resin chain teeth on said second surface of said chain cloth, said second sewing thread repeatedly passing through the said loops of said first sewing threads on both sides of each said resin chain tooth, so that said second sewing thread forms a three-segment thread body tightly bound in said sewing thread slot.

10. The flat bottom resin zipper as claimed in claim 8, wherein said chain cloth embedding groove is a groove with a rectangular or semicircular section.

* * * * *